US005415810A

United States Patent [19]

Lee et al.

[11] Patent Number: 5,415,810

[45] Date of Patent: May 16, 1995

[54] DETERGENT COMPOSITION

[75] Inventors: Robert S. Lee, Spital; Tom M. F. Salmon, Chester, both of United Kingdom

[73] Assignee: Lever Brothers Company, Division of Conopco, Inc., New York, N.Y.

[21] Appl. No.: 132,774

[22] Filed: Oct. 6, 1993

Related U.S. Application Data

[63] Continuation of Ser. No. 971,384, Nov. 4, 1992, abandoned.

[30] Foreign Application Priority Data

Nov. 5, 1991 [GB] United Kingdom ..... 9123422

[51] Int. Cl.[6] ..... C11D 1/84

[52] U.S. Cl. ..... 252/545; 252/546; 252/550; 252/554; 252/557; 252/173; 252/DIG. 14

[58] Field of Search ..... 257/DIG. 14, 173, 554, 257/550, 546, 557, 545

[56] References Cited

U.S. PATENT DOCUMENTS

| | | | |
|---|---|---|---|
| 3,086,943 | 4/1963 | Lang | 252/557 |
| 4,554,098 | 11/1985 | Klish et al. | 252/558 |
| 4,595,526 | 6/1986 | Lai | 252/557 |
| 5,132,037 | 7/1992 | Greene et al. | 252/557 |

*Primary Examiner*—Linda Skaling
*Assistant Examiner*—Nechohus Ogden
*Attorney, Agent, or Firm*—Ronald A. Koatz

[57] ABSTRACT

Aqueous detergent compositions giving good mildness, good lather volume and lather creaminess contain acyl isethionate, a zwitterionic detergent which is a quaternised amino acid, usually a betaine, and another anionic detergent. Proportions and ratios are specified and alkanolamides are absent or limited in amount. Incorporation of the additional anionic detergent, such as ether sulphate, has surprisingly little adverse effect and provides economy.

15 Claims, No Drawings

DETERGENT COMPOSITION

This is a continuation of Ser. No. 07/971,384, filed Nov. 4, 1992, now abandoned.

This invention relates to detergent compositions in liquid or gel form, suitable for personal washing of either skin or hair. It is desirable that such compositions should be mild to the skin (even if intended for use as a hair shampoo) yet able to generate lather which the user will judge to be good, both in quantity and quality. It is not easy to achieve mildness simultaneously with good lather. For example sodium lauryl sulphate is high foaming but harsh while alcohol ethoxylates are mild but low foaming. It is of course also desirable to achieve economy in cost of materials.

We have now found that a good combination of properties can be obtained by use of a detergent mixture in which a combination of fatty acyl isethionate and a zwitterionic detergent constitute a high proportion of the detergent mixture, but some other anionic detergent is also included.

Some prior proposals for compositions containing fatty acyl isethionate have included polar nonionic detergents, notably alkanolamides such as coconut mono- or di-ethanolamide. This is logical because these materials are well known as lather enhancers. Surprisingly we have found that alkanolamides are not helpful in combinations of acyl isethionate and betaine, and their use has undesirable effects.

According to the present invention there is provided a detergent composition in the form of an aqueous liquid or gel, comprising 10 to 50% by weight of a detergent mixture which comprises (a) 10 to 60% by weight of the detergent mixture of a fatty acyl isethionate of formula $$R—CO_2—CH_2CH_2—SO_3M$$

where R is an alkyl group of 7 to 21 carbon atoms and M is a solubilising cation such as sodium, potassium, ammonium or substituted ammonium, (b) 10 to 80% by weight of the detergent mixture of a zwitterionic detergent which has a hydrophilic head group containing a quaternary nitrogen atom and at least one acid group, (c) 10 to 55% by weight of the detergent mixture of a further anionic detergent, wherein the amount by weight of the fatty acyl isethionate (a) is not more than three times the amount by weight of the zwitterionic detergent (b), the total of (a) and (b) is from 45 to 90% by weight of the detergent composition, and the composition is sufficiently free of alkanolamide detergents that the amount by weight of alkanolamide is not more than one quarter the amount of the zwitterionic detergent (b).

The materials used in the present application, and the relationships between them will now be discussed in more detail.

Fatty acyl isethionates may be prepared by the reaction between alkali metal isethionate and aliphatic fatty acids (or their acid chlorides) having from 8 to 22 carbon atoms. Preferably these fatty acids have an iodine value of less than 20. Generally a mixture of aliphatic fatty acids will be used. In one embodiment of the invention at least three quarters of the fatty acyl groups in the acyl isethionate have from 12 to 18 carbon atoms while the balance, up to a quarter of the fatty acyl groups, may have from 8 to 10 carbon atoms. Notably the fatty acyl groups may be provided by coconut fatty acid.

We have found that fatty acyl isethionate contributes to mildness in the detergent mixtures of this invention, and also contributes to obtaining foam of good volume and/or quality, as will be mentioned again below. Even fairly low levels of acyl isethionate will contribute to these benefits.

A difficulty with fatty acyl isethionate is that it has a low solubility in water which is an obstacle to incorporating it into aqueous compositions. Typical solubility in distilled water is 0.01% by weight at 25° C. We have found that the use of the zwitterionic detergent required for this invention can achieve dissolution of acyl isethionate at a much greater concentration than would dissolve in the absence of this second detergent.

The difficulty of solubilising isethionate is of increasing significance as the percentage of this material in the composition increases, of course. In certain preferred forms of the present invention the concentration of fatty acyl isethionate is at least 6% by weight of the composition. Dissolution of the acyl isethionate in an aqueous phase is desirable, since it can lead to a product which is more attractive to the consumer and more stable during storage. It is also valuable in that it simplifies the manufacturing process. Consequently in preferred forms of the compositions the detergent mixture is fully soluble in the aqueous phase of the composition. The composition may then be an isotropic solution or may lack optical clarity solely because of some other constituent such as an opacifying or pearlescent agent.

Materials which do not readily enter aqueous solution include free fatty acids, especially those of longer chain length. It is preferred that fatty acids, especially those with 16 or more carbon atoms, are absent from compositions of this invention.

For solubilising fatty acyl isethionate it is generally desirable that the quantity of the zwitterionic detergent is not less than one third the weight of fatty acyl isethionate. Better is that the amount of zwitterionic detergent is at least half the weight of isethionate.

Use of fatty acyl isethionate jointly with zwitterionic detergent is also advantageous in yielding good foam volume and/or foam with a thick, creamy quality. Both of these properties are important to the end user's perception of the quality of the product. One or other of these advantageous properties can be obtained even when the proportion of zwitterionic is relatively high. However, the quality and/or quantity of foam is generally best when the ratio of fatty acyl isethionate to zwitterionic detergent lies in a range from 3:1 to 1:3. A range from 2:1 to 1:2 is preferred.

The zwitterionic detergent, when used jointly with isethionate, enhances mildness. For particularly good mildness it is preferred that the zwitterionic detergent is at least 30% by weight of the mixture of detergents. For good lather, it is preferred not to have much more than 60% by weight of zwitterionic. This is consistent with the above preferred range of isethionate to zwitterionic.

The combined amount of zwitterionic and acyl isethionate detergents may well be at least 50 or 55% of the detergent mixture, for instance 55 to 75% for the sake of mildness together with economy from inclusion of other anionic detergent. The range from 75 to 90% of the detergent mixture can also be utilised, however.

Zwitterionic detergents for use in this invention include at least one acid group. This may be a carboxylic or a sulphonic acid group. They include quaternary nitrogen and therefore are quaternary amino acids. They should generally include an alkyl or alkenyl group of 7 to 18 carbon atoms. They will usually comply with an overall structural formula

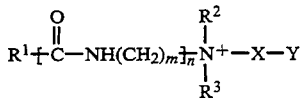

where $R^1$ is alkyl or alkenyl of 7 to 18 carbon atoms $R^2$ and $R^3$ are each independently alkyl, hydroxyalkyl or carboxyalkyl of 1 to 3 carbon atoms m is 2 to 4 n is 0 or 1

X is alkylene of 1 to 3 carbon atoms optionally substituted with hydroxyl, and

Y is $—CO_2^-$ or $—SO_3^-$

Suitable zwitterionic detergents within the above general formula include simple betaines of formula:

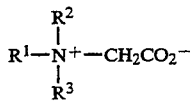

and amido betaines of formula:

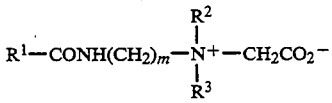

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the zwitterionic detergent is a sulphobetaine of formula

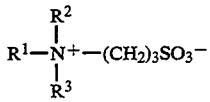

or

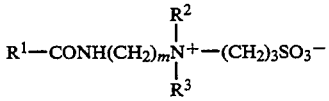

where m is 2 or 3, or variants of these in which $—(CH_2)_3SO_3^-$ is replaced by

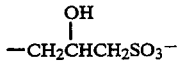

In these formulae $R^1$, $R^2$ and $R^3$ are as discussed previously.

The invention also requires that some anionic detergent other than acyl isethionate is included in the composition. Conventional anionic detergents are not effective to solubilise fatty acyl isethionate, so it could not be predicted that their presence would be useful or even tolerable. However, we have found that some anionic detergent can be included as a proportion of the detergent mixture, with surprisingly little deteriment to the mildness of the composition. Incorporation of anionic detergent is beneficial in that it can act as a partial replacement for the mixture of acyl isethionate and zwitterionic. This can give a saving in cost because acyl isethionate and zwitterionic detergent are both relatively expensive materials.

A further advantage for the addition of a second anionic detergent is in providing greater control over viscosity. Binary mixtures of acyl isethionate and zwitterionic detergents often have higher low-shear viscosity than desired for some product formulations. While viscosity can be reduced by the addition of alcohol or polyol hydrotropes, lather performance is reduced by the inclusion of these materials. The use of other anionic detergent allows the systems to be formulated with control of viscosity in the desired range by addition of electrolyte and with surprisingly little reduction in lathering characteristics.

The anionic detergent which is included is particularly envisaged as ether sulphate of the formula $$R^4O(CH_2CH_2O)_tSO_3M$$

where $R^4$ is alkyl or alkenyl of 8 to 18 carbon atoms, especially 11 to 15 carbon atoms, t has an average value of at least 2.0 and M is a solubilising cation such as sodium, potassium, ammonium or substituted ammonium. Preferably t has an average value of 3 or more.

Other anionic detergents may be used. Possibilities include alkyl glyceryl ether sulphates, sulphosuccinates, taurates, sarcosinates, sulphoacetates, alkyl phosphates and acyl lactates. Sulphosuccinates may be monoalkyl sulphosuccinates having the formula:

$R^5O_2CCH_2CH(SO_3M)CO_2M$; and amido-MEA sulphosuccinates of the formula: $R^5CONHCH_2CH_2O_2CCH_2CH(SO_3M)CO_2M$; wherein $R^5$ ranges from $C_8$–$C_{20}$ alkyl, preferably $C_{12}$–$C_{15}$ alkyl and M is a solubilising cation.

Sarcosinates are generally indicated by the formula $R^5CON(CH_3)CH_2CO_2M$, wherein R ranges from $C_8$–$C_{20}$ alkyl, preferably $C_{12}$–$C_{15}$ alkyl and M is a solubilising cation.

Taurates are generally identified by the formula $R^5CONR^6CH_2CH_2SO_3M$, wherein $R^5$ ranges from $C_8$–$C_{20}$ alkyl, preferably $C_{12}$–$C_{15}$ alkyl, $R^6$ ranges from $C_1$–$C_4$ alkyl, and M is a solubilising cation.

The anionic detergent included in the composition will generally be selected to avoid harsh detergent such as primary alkane sulphonate or alkyl benzene sulphonate. The amount, if any, of these is preferably less than 3% of the detergents present.

The anionic detergent or mixture of anionic detergents is preferably sufficiently mild in its own right that if tested alone by the zein solubilisation test described in Example 2 below, it causes no greater solubilisation than does an equal concentration of sodium lauryl ether sulphate with average two ethylene oxides per molecule.

Alkanolamide detergents are required to be included at only a low level, if at all. We have found that they reduce mildness rather considerably, even if used in a mixture with the specified zwitterionic detergent. Preferably they are restricted to not more than 5% by weight of the detergent mixture, or one quarter the amount of the zwitterionic, whichever is less. Even better is to exclude alkanolamides and the harsh anionics, alkyl benzene sulphonate and primary alkane sulphonate completely.

Provided the requirements for the minimum quantities of fatty acyl isethionate, the zwitterionic detergent and other anionic detergent are met, additional amphoteric or nonionic detergent may be included. Preferred, however, is to avoid amine oxide, which reduces lather quality. Accordingly, if amine oxide is present at all, the amount may also be less than 5% of the detergents present.

Other materials may be included in compositions of this invention. Possibilities include colouring agents, opacifying agents, organic polymers, perfumes including deodorant perfumes, bactericidal agents to reduce the microflora on skin, antioxidants and other preservatives, and skin feel modifiers.

Organic polymers which may be present include crosslinked polyacrylates such as the Carbopol polymers available from Goodrich. These can function to increase viscosity or enhance stability of a composition. Polysaccharides are also well known as thickening agents and many are cellulose or cellulose derivatives.

The compositions of this invention will generally be pourable liquids or semi-liquids, although they may be somewhat viscous. For this, they may be thickened by including electrolyte. Ammonium salts are preferred over sodium salts which reduce the solubility of fatty acyl isethionate.

Compositions of this invention may be formulated as products for washing the skin, e.g. bath or shower gels, hand washing compositions or facial washing liquids. They may also be formulated as hair shampoos.

A viscosity of at least 0.5 Pa.sec at a low shear rate of 10 to 25 $sec^{-1}$ may be desired for most product forms. Hair shampoos will generally have a viscosity of at least 1 Pa.sec at such shear rate. Products for washing the skin are customarily more viscous. A viscosity of at least 2 or even at least 3 Pa.sec at the same shear rate is usually appropriate for these.

EXAMPLE 1

Various binary mixtures were made containing sodium cocoyl isethionate and another detergent. The sodium cocoyl isethionate was Fenopon (Registered Trade Mark) AC78 available from GAF Corporation. It has a water solubility, in distilled water at 25° C., of about 0.01% by weight.

Other detergents were:

(i) coconut amidopropyl betaine (CAPB) of formula:

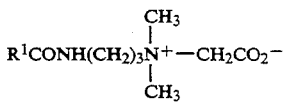

in which $R^1CO$— is a mixture of acyl groups derived from coconut with $C_{12}$ and $C_{14}$ together constituting a majority. This was Tegobetain L7 from Goldschmidt.

(ii) coconut betaine of formula:

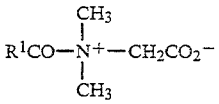

in which $R^1CO$— is a mixture of acyl groups derived from coconut. This betaine was Empigen BB from Albright and Wilson.

(iii) coconut amidopropyl sulphobetaine of formula:

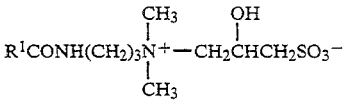

in which $R^1CO$ is again coconut-derived acyl. This was Rewoteric AM-CAS from Rewo.

(iv) coconut diethanolamide (CDEA) which was Empilan CDE from Albright and Wilson.

(v) sodium lauryl ether sulphate with average three ethylene oxide residues (SLES) which was Empicol 0251 from Albright and Wilson.

(vi) disodium lauryl ether sulphosuccinate with average 3EO, which was Rewopol SBFA from Rewo.

The amount of mixture which could be dissolved to an isotropic solution in demineralized water was measured for mixtures containing 80%, 60% and 40% of the isethionate, with 20%, 40% and 60% respectively of each other detergent.

The results are set out in the following Table 1.

TABLE 1

| Solubilities of binary mixtures as isotropic solutions in distilled water (% w/w) | | | |
|---|---|---|---|
| | Ratio of isethionate: second detergent | | |
| Second detergent in mixture | 80:20 | 60:40 | 40:60 |
| (i) CAPB | below 10% | 15–20% | 35–40% |
| (ii) betaine | 15–20% | 30–35% | 30–35% |
| (iii) sulpho-betaine | below 10% | 20–25% | 25–30% |
| (iv) CDEA | below 10% | 30–40% | 30–40% |
| (v) SLES | below 10% | below 10% | below 10% |
| (vi) sulpho-succinate | below 10% | below 10% | below 10% |

This shows that the switterionic detergent (i), (ii) and (iii) were effective to solublise the acyl isethionate, unlike the two anionic detergents (v) and (vi). CDEA was also effective.

EXAMPLE 2

A number of detergents and mixtures were assessed for mildness using the zein solubilisation test.

This test was first described by Gotte, Proc. Int. Congr. Surface Active Subs., 4th, Brussels 3 83–90, 1094. In this test, as carried out by us, 5g of zein (which is a protein available from Kodak) was mixed with 40 ml of a detergent solution (which in this example contained 1.2 g detergent), then shaken for 1 hour at 35° C. Solids were then removed by centrifuging. The supernatant was filtered and the amount of protein in the filtered supernatant was determined by analysis for nitrogen. Correction was made for any nitrogen from the detergent itself. The result is a measure of the harshness of the detergent, since a mild detergent solubilises protein from the zein to a lesser extent than a harsh detergent.

The detergents were sodium cocoyl isethionate (Fenopon AC78 as in Example 1), cocoamidopropyl betaine (CAPB) which was Rewoteric AMB14 from Rewo and sodium lauryl ether sulphate (SLES) with average 3EO (Genapol ZRO from Hoechst). All materials and mixtures were tested at an overall detergent concentration of 3% by weight.

All the detergent solutions were clear, isotropic liquids. The proportions of detergents in the solutions tested, and the zein solublisation results are set out in the following Table:

TABLE 2

| | wt % of total detergent | | | | | | | | | |
|---|---|---|---|---|---|---|---|---|---|---|
| Example no. | 2A | 2B | 2C | 2D | 2E | 2F | 2G | 2H | 2J | 2K |
| Isethionate: | 0 | 0 | 18 | 0 | 50 | 50 | 16 | 33 | 15 | 30 |
| CAPB: | 0 | 33 | 18 | 20 | 25 | 40 | 42 | 33 | 70 | 15 |
| SLES: | 100 | 66 | 64 | 80 | 25 | 10 | 42 | 33 | 15 | 55 |
| zein solublisation: (% N) | 0.55 | 0.35 | 0.25 | 0.40 | 0.24 | 0.15 | 0.07 | 0.19 | 0.09 | 0.25 |

Comparison of Examples 2A, 2B and 2D shows that the CAPB improves mildness of SLES. However, Example 2C is milder than Example 2B with the same amount of SLES and also milder than Example 2D with the same amount of CAPB.

Examples 2E to 2K show good mildness over the area where isethionate and CAPB together constitute at least 45% by weight of the detergent active, especially when the CAPB is at least 30% by weight of the total detergent.

EXAMPLE 3

The foaming properties of various compositions were assessed by a panel of twenty persons trained in magnitude estimation techniques. Each panellist wore surgical gloves which had first been washed with soap to remove any talc.

0.5 g of test composition was dosed onto the wet gloves, and the panellist rubbed his or her hands together to generate lather. The panellist estimated the magnitude of the volume of lather and also the extent to which the lather appears thick and creamy.

The results are expressed as the normalised averages of the scores given by the panellists. We have found good correlation between estimates of lather volume and volumes actually collected into a measuring cylinder.

In this example the compositions were isotropic aqueous solutions of sodium cocoyl isethionate (Fenopon ACкas in Example 1) and a simple betaine. (Empigen BB as in Example 1).

A control solution contained sodium lauryl ether sulphate (average 3EO) and the same betaine (a mixture which is typical of a conventional shower gel or shampoo).

All the solutions contained 15% by weight of detergent. The results obtained were:

TABLE 3

| | panel scores | |
|---|---|---|
| Weight ratio | lather volume | creaminess |
| isethionate:betaine | | |
| 70:30 | 139 | 145 |
| 60:40 | 110 | 120 |
| 50:50 | 110 | 120 |
| 40:60 | 88 | 121 |
| Control SLES:betaine | | |

TABLE 3-continued

| | panel scores | |
|---|---|---|
| Weight ratio | lather volume | creaminess |
| 86:14 | 101 | 87 |

This shows that the isethionate mixtures gave better foam volume than the control solution except when the quantity of betaine exceeded the quantity of isethionate, while the creaminess of the lather was better at all the proportions of betaine.

EXAMPLE 4

The procedure of Example 3 was repeated using solutions of cocoyl isethionate, betaine and sodium lauryl ether sulphate, with average 3EO. These were Fenopon AC78, Empigen BB and Empicol 0251 all as in Example 1. The same control solution of SLES and betaine was used. All solutions were isotropic and contained a total of 15% by weight of detergent. The results obtained were:

TABLE 4

| Weight ratio isethionate:betaine:SLES | | | panel scores lather volume | lather creaminess |
|---|---|---|---|---|
| 60 | 30 | 10 | 112 | 99 |
| 60 | 20 | 20 | 96 | 99 |
| 50 | 40 | 10 | 105 | 100 |
| 50 | 20 | 30 | 97 | 100 |
| 40 | 30 | 30 | 97 | 102 |
| 30 | 35 | 35 | 94 | 99 |
| | 14 | 86 | 98 | 97 |

It will be observed that lather volume and creaminess were about equal to the control or better.

EXAMPLE 5

A number of aqueous solutions of sodium cocoyl isethionate and a second detergent were made and assessed for lathering as in Example 3. The isethionate was Fenopon AC78 as in Examples 1 and 3. The second detergent was either Empigen BB as in Examples 1 and 3, or a $C_{12}$ to $C_{14}$ alkyl dimethyl amine oxide (Empigen OB from Albright and Wilson). The same ether sulphate/betaine control solution was used. All solutions contained 15% by weight of detergent. The results obtained were:

TABLE 5

| Weight ratio isethionate:betaine:amine oxide | | | panel scores lather volume | lather creaminess |
|---|---|---|---|---|
| 50 | — | 50 | 115 | 88 |
| 60 | — | 40 | 115 | 95 |
| 60 | 40 | — | 100 | 110 |
| 70 | — | 30 | 97 | 100 |
| 70 | 30 | — | 105 | 90 |
| Control | 86 SLES: | 14 betaine | 85 | 99 |

This shows that amine oxide gave some superiority in foam volume, when used at higher proportions but was then inferior to betaine in creaminess of lather.

EXAMPLE 6

Solutions were prepared containing sodium cocoyl isethionate (Fenopon AC78 as in Example 1) sodium lauryl ether sulphate with average 3EO and another detergent active which was either or both of coconut diethanolamide (CDEA) and coconut amidopropyl betaine (CAPB: Rewoteric AMB14 as in Example 2).

All solutions contained 15% by weight detergent. The amounts of detergent, as weight percentages of total detergent, together with the total panel scores for lather and creaminess were:

TABLE 6

| | % by weight based on total detergent | | | | | |
|---|---|---|---|---|---|---|
| Isethionate | 33 | 33 | 33 | 50 | 50 | 50 |
| CAPB | 54 | — | 27 | 40 | — | 20 |
| CDEA | — | 54 | 27 | — | 40 | 20 |
| SLES | 13 | 13 | 13 | 10 | 10 | 10 |
| | | | | panel scores | | |
| Volume | 125 | 86 | 98 | 105 | 92 | 99 |
| Creaminess | 114 | 99 | 110 | 92 | 86 | 98 |

These results show that incorporation of CDEA in place of betaine gives little or no benefit as regards lather, and can be detrimental.

EXAMPLE 7

The procedure of Example 3 was repeated using solutions of cocoyl isethionate (Fenopon AC78 as in Examples 1 and 3) coconut amidopropyl betaine (Rewoteric AMB14 as in Example 2) and a third detergent in a weight ratio of 50:40:10 by weight. The third detergent was selected from:

(i) sodium lauryl sarcosinate (Hamposyl L-95 from W. R. Grace)

(ii) sulphosuccinate (Rewopol SBFA as in Example 1)

(iii) sodium lauryl sulphate (Empicol LX 28 from Albright and Wilson)

(iv) alcohol ethoxylate ($C_{12-13}$ fatty alcohol ethoxylated with average 8 ethylene oxide residues).

All solutions contained 15% by weight detergent. A control solution as in Examples 3 and 4 was used. The results were:

TABLE 7

| | Total panel scores | |
|---|---|---|
| Third detergent | lather volume | lather creaminess |
| (i) sarcosinate | 110 | 101 |
| (ii) sulphosuccinate | 102 | 97 |
| (iii) lauryl sulphate | 91 | 106 |
| (iv) alcohol ethoxylate | 82 | 90 |
| Control 86 SLES:14 betaine | 94 | 103 |

This shows that the alcohol ethoxylate had an adverse effect on lather which the anionic detergents did not.

EXAMPLE 8

A number of aqueous solutions of sodium cocoyl isethionate and a second detergent were made and assessed for lathering as in Example 3. The isethionate was Fenopon AC78 as in Examples 1 and 3, coconut amidopropyl sulphobetaine (Rewoteric AM-GAS as in Example 1) or coconut amidopropyl betaine (CAPB) derived from middle cut coconut oil so that substantially all the long chain acyl groups $R^1CO$ contain 12 or 14 carbon atoms (Tegobetain L5351 from Goldschmidt). The same ether sulphate/betaine control solution was used. All solutions contained 15% by weight of detergent. The results obtained were:

TABLE 8

| proportions | | | panel scores | |
|---|---|---|---|---|
| isethionate | sulphobetaine | CAPB | lather volume | creaminess |
| 70 | 30 | — | 106 | 94 |
| 60 | 40 | — | 113 | 106 |
| 50 | 50 | — | 97 | 88 |
| 70 | — | 30 | 95 | 100 |
| 60 | — | 40 | 96 | 111 |
| 50 | — | 50 | 111 | 108 |
| Control | 86 SLES: 14 betaine | | 95 | 93 |

This demonstrates the effectiveness of these two zwitterionic detergents.

EXAMPLE 9

The procedure of Example 3 was repeated using two solutions of cocoyl isethionate (Fenopon AC78 as in Examples 1 and 3), coconut amidopropyl betaine (Rewoteric AMB14 as in Example 2) and in one solution sodium lauryl ether sulphate with average 3EO (Empicol 0251 as in Example 1 ). The solutions were thickened by incorporation of ammonium chloride.

One solution contained isethionate, CAPB and SLES in a weight ratio of 33:54:13. The other contained equal weights of isethionate and CAPB without SLES. Both contained 15% by weight detergent in total. Both were isotropic.

The panel scores for lather volume and creaminess were the same for both solutions and matched the scores for 86 SLES: 14 betaine used as control.

EXAMPLE 10

Various compositions were assessed for mildness by the zein test as in Example 2. The compositions contained sodium cocoyl isethionate (Fenopon AC78 as in Example 1) sodium lauryl ether sulphate with average 3EO and CAPB, CDEA or a mixture of the two as in Example 5.

All solutions contained 3% detergent. The proportions of the constituents, as percentages by weight of total detergent, and the zein solubilisation figures were as follows:

TABLE 9

| | % by weight of total detergent | | | | | | | | | | | | |
|---|---|---|---|---|---|---|---|---|---|---|---|---|---|
| Isethionate | 50 | 50 | 50 | 50 | 50 | 33 | 33 | 33 | 33 | 33 | 16 | 16 | 16 |
| CAPB | 40 | — | 20 | 25 | — | 54 | — | 27 | 33 | — | 42 | — | 21 |
| CDEA | — | 40 | 20 | — | 25 | — | 54 | 27 | — | 33 | — | 42 | 21 |
| SLES | 10 | 10 | 10 | 25 | 25 | 13 | 13 | 13 | 33 | 33 | 42 | 42 | 42 |
| Zein | 0.15 | 0.38 | 0.31 | 0.25 | 0.49 | 0.07 | 0.27 | 0.20 | 0.19 | 0.40 | 0.07 | 0.34 | 0.29 |

TABLE 9-continued

| | % by weight of total detergent |
|---|---|
| solublisation (% N) | |

These results show very clearly that alkanolamide is detrimental to mildness even when used jointly with CAPB.

EXAMPLE 11

Binary mixtures were tested for mildness by zein test, using solutions containing 10% by weight detergent. The mixtures contained sodium cocoyl isethionate with CAPB, a simple betaine (Empigen BB) or CDEA. The results obtained were:

TABLE 10

| | % by weight of total detergent | | | | | | | | |
|---|---|---|---|---|---|---|---|---|---|
| Isethionate | 70 | 70 | 70 | 60 | 60 | 60 | 50 | 50 | 50 |
| CAPB | 30 | — | — | 40 | — | — | 50 | — | — |
| Betaine | — | 30 | — | — | 40 | — | — | 50 | — |
| CDEA | — | — | 30 | — | — | 40 | — | — | 50 |
| Zein solublisation (% N) | 0.52 | 0.49 | 1.01 | 0.34 | 0.34 | 0.85 | 0.24 | 0.21 | 0.66 |

This data shows that there is very little difference in mildness between CAPB and simple betaine. It confirms that ethanolamide is detrimental to mildness.

EXAMPLE 12

A shower gel contained the following:

| | % by weight |
|---|---|
| Sodium cocoyl isethionate (Fenopon AC78) | 5.0 |
| Coconut amidopropyl betaine (Tegobetain L7) | 8.0 |
| Sodium lauryl ether sulphate 3EO (Empicol 0251) | 2.0 |
| Isopropyl palmitate | 0.5 |
| Opacifier | 1.0 |
| Glycerol | 1.25 |
| Preservative | 0.07 |
| Sodium chloride | 3.5 |
| Perfume | 1.5 |
| Water | balance to 100% |

The three detergents were fully dissolved in the aqueous phase. The opacifier, a polystyrene latex, was in suspension.

EXAMPLE 13

A hand washing composition contained the following:

| | % by weight |
|---|---|
| Sodium cocoyl isethionate | 2.0 |
| Coconut amidopropyl betaine | 5.3 |
| Sodium lauryl ether sulphate 3EO | 5.3 |
| Ethylene glycol monostearate | 2.0 |
| Sodium chloride | 2.0 |
| Triclosan (antimicrobial agent) | 0.4 |
| Perfume | 0.4 |
| Preservatives, colourants | q.s. |
| Water | balance to 100% |

The three detergents were fully dissolved in the aqueous phase. The ethylene glycol monostearate was in suspension and functioned as an opacifier.

EXAMPLE 14

A shower gel contained the following:

| | % by weight |
|---|---|
| Sodium cocoyl isethionate (Fenopon AC78) | 7.5 |
| Coconut amidopropyl betaine (Rewoteric AMB14) | 5.0 |
| Sodium lauryl ether sulphate 3EO (Genapol ZRO) | 2.5 |
| Preservative | 0.07 |
| Ammonium chloride | 1.8 |
| Perfume | 1.0 |
| Water | balance to 100% |

This is a clear gel.

EXAMPLE 15

A hair shampoo contained the following:

| | % by weight |
|---|---|
| Sodium cocoyl isethionate (Fenopon AC78) | 5.0 |
| Coconut amidopropyl betaine (Rewoteric AMB14) | 5.0 |
| Sodium lauryl ether sulphate 3EO (Genapol ZRO) | 5.0 |
| Preservative | 0.07 |
| Sodium chloride | 2.2 |
| Perfume | 0.5 |
| Water | balance to 100% |

The shampoo was a clear, isotropic liquid.

We claim:

1. A detergent composition in the form of an aqueous liquid or gel comprising 10% to 50% by weight of a detergent mixture which comprises (a) 10 to 60% by weight of the detergent mixture of a fatty acyl isethionate of formula $$R—CO_2—CH_2CH_2—SO_3M$$

where R is an alkyl or alkenyl group of 7 to 21 carbon atoms and M is a solubilising cation such as sodium, potassium, ammonium or substituted ammonium;

(b) 10 to 80% by weight of the detergent mixture of a zwitterionic detergent which has a hydrophilic head group containing a quaternary nitrogen atom and at least one acid group, (c) 10 to 55% by weight of the detergent mixture of a further anionic detergent other than acyl isethionate, wherein the amount by weight of the fatty acyl isethionate (a) is not more than three times the amount by weight of the zwitterionic detergent (b), the total of (a) and (b) is from 45 to 90% by weight of the detergent mixture, and the composition is sufficiently free of alkanolamide detergents that the amount by weight of alkanolamide is not more than one quarter the amount of the zwitterionic detergent (b).

2. A composition according to claim 1 wherein the zwitterionic detergent (b) is 30% to 60% by weight of the detergent mixture.

3. A composition according to claim 1 wherein the fatty acyl isethionate (a) and zwitterionic detergent (b) together constitute 55 to 75% by weight of the detergent mixture.

4. A composition according to claim 1 wherein the weight ratio of the fatty acyl isethionate and zwitterionic detergent lies in a range from 2:1 to 1:2.

5. A composition according to claim 1 containing at least 6% by weight of the whole composition of the fatty acyl isethionate (a) and at least 3% by weight of the whole composition of the zwitterionic detergent (b).

6. A composition according to claim 1 wherein at least three quarters of the groups R of the acyl isethionate are alkyl of 11 to 17 carbon atoms.

7. A composition according to claims 1 wherein said zwitterionic detergent is of the formula $$R^1[\overset{\overset{\displaystyle O}{\|}}{C}-NH-(CH_2)_m]_n-\overset{\overset{\displaystyle R^2}{|}}{\underset{\underset{\displaystyle R^3}{|}}{N}}{}^{+}-CH_2CO_2^-$$

where $R^1$ is alkyl or alkenyl of 7 to 18 carbon atoms $R^2$ and $R^3$ are each independently alkyl, hydroxyalkyl or carboxyalkyl of 1 to 3 carbon atoms m is 2 to 4 n is 0 or 1.

8. A composition according to claim 7 wherein at least three quarters of the groups $R^1$ have 12 to 14 carbon atoms and $R^2$ and $R^3$ are methyl.

9. A composition according to claim 1 wherein said further anionic detergent (c) is selected from the group consisting of alkyl ether sulphates, alkyl glyceryl sulphates, sulphosuccinates, taurates, sarcosinates, sulphoacetates, alkyl phosphates and acyl lactates.

10. A composition according to claim 1 wherein said further anionic detergent (c) is alkyl ether sulphate with an average of at least 2.5 ethylene oxide residues per molecule.

11. A composition according to claim 1 wherein the amount of alkanolamide detergent, if any, is not more than 5% by weight of the detergent mixture.

12. A composition according to claim 1 wherein the amount of amine oxide detergent, if any, is not more than 5% by weight of the detergent mixture.

13. A composition according to claim 1 which also contains inorganic electrolyte.

14. A detergent composition according to claim 1, wherein the amount by weight of the fatty acyl isethionate (a) is not more than about two times the amount of the zwitterionic detergent (b).

15. A detergent composition according to claim 1, wherein the surfactants of the surfactant mixture are solubilized in the composition.

* * * * *